US006481163B1

(12) United States Patent
King et al.

(10) Patent No.: US 6,481,163 B1
(45) Date of Patent: Nov. 19, 2002

(54) PARTITION PANEL

(75) Inventors: Jonathan J. King, East Grand Rapids, MI (US); Alan E. Rheault, Grand Rapids, MI (US); John S. Malnor, East Grand Rapids, MI (US); Daniel R. VanDyk, Belding, MI (US); Michael L. Waalkes, East Grand Rapids, MI (US); Errol S. Pearsons, Grand Haven, MI (US); Bruce W. DuVall, Jr., Byron Center, MI (US); William K. Hofman, Ada, MI (US); Daniel N. Phillips, Belmont, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/692,786

(22) Filed: Oct. 20, 2000

(51) Int. Cl.[7] ..... E04B 2/38

(52) U.S. Cl. ..... 52/36.6; 52/239; 52/775; 52/781

(58) Field of Search ..... 52/36.1, 36.4, 52/36.5, 36.6, 238.1, 239, 775, 781

(56) References Cited

U.S. PATENT DOCUMENTS

| | | | | | |
|---|---|---|---|---|---|
| 3,001,615 | A | | 9/1961 | Ries | |
| 3,592,289 | A | * | 7/1971 | Aysta et al. | 52/656.9 X |
| 3,802,146 | A | | 4/1974 | Tacke et al. | |
| 3,916,972 | A | | 11/1975 | Breiner | |
| 3,958,386 | A | | 5/1976 | Pollock | |
| 4,631,881 | A | | 12/1986 | Charman | |
| 4,667,450 | A | * | 5/1987 | Stefnik et al. | 52/238.1 |
| 4,795,355 | A | | 1/1989 | Dorn et al. | |
| 4,881,349 | A | | 11/1989 | Brown et al. | |
| 5,024,030 | A | * | 6/1991 | Morrison | 52/36.1 |
| 5,070,666 | A | | 12/1991 | Looman | |
| 5,086,606 | A | | 2/1992 | Finses | |
| 5,172,530 | A | * | 12/1992 | Fishel et al. | 52/239 X |
| 5,277,007 | A | | 1/1994 | Hellwig et al. | |
| 5,433,046 | A | * | 7/1995 | MacQuarrie et al. | 52/238.1 |
| 5,474,402 | A | | 12/1995 | Wu | |
| 5,479,747 | A | | 1/1996 | Wu | |
| 5,586,593 | A | | 12/1996 | Schwartz | |
| 5,724,779 | A | | 3/1998 | Chang | |
| 5,737,893 | A | | 4/1998 | Rossiter et al. | |
| 5,831,211 | A | | 11/1998 | Gartung et al. | |
| 5,875,596 | A | | 3/1999 | Muller | |
| 5,930,963 | A | * | 8/1999 | Nichols | 52/239 |
| 6,000,179 | A | * | 12/1999 | Musculus et al. | 52/239 |
| 6,037,538 | A | | 3/2000 | Brooks | |
| 6,112,472 | A | * | 9/2000 | Van Dyk et al. | 52/239 X |
| 6,336,298 | B1 | * | 1/2002 | Chou | 52/238.1 |

FOREIGN PATENT DOCUMENTS

| | | | | |
|---|---|---|---|---|
| GB | 2060022 | * | 4/1981 | 52/36.5 |
| WO | WO0021412 | | 10/1999 | |

* cited by examiner

*Primary Examiner*—Laura A. Callo
(74) *Attorney, Agent, or Firm*—Price, Heneveld, Cooper, DeWitt & Litton

(57) ABSTRACT

A partition frame includes vertically spaced apart upper and lower horizontal frame members. The partition frame also has a pair of horizontally spaced apart vertical frame members extending between and interconnecting the upper and lower frame members to form a generally rectangular frame. The vertical frame members have a vertical row of openings configured to support hang-on accessories, and the upper frame member includes a horizontal row of openings configured to support hang-on accessories.

17 Claims, 5 Drawing Sheets

PARTITION PANEL

BACKGROUND OF THE INVENTION

Modern offices are becoming increasingly complicated and sophisticated due largely to the ever increasing needs of the users for improved utilities support at each workstation, such as communications, computers and other types of data processors, electronic displays, etc., including physical accommodations, such as lighting, HVAC, security, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving incredibly complex problems. Such equipment has very stringent power and signal requirements, and must quickly and efficiently interface with related equipment at both adjacent and remote locations. Work areas with readily controllable lighting, HVAC, sound masking, and other physical support systems, are also highly desirable to maximize worker creativity and productivity. Many other types of high technology equipment and facilities are also presently being developed which will find their place in the workplaces of the future.

One important consequence of the advent of sophisticated electronic offices is the increased need and desirability for distributing utilities throughout the various offices in a manner which can be readily reconfigured. The term "utilities" as used herein incorporates a wide variety of facilities for use at a workstation, including security devices, electrical power, signal and/or communications, HVAC, water and other fluids, and other similar resources. The ability to provide the worker with ready access to all of these utilities is clearly advantageous in the quest to promote worker well being and effectiveness.

The efficient use of building floor space is also an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as worksurfaces, overhead cabinets, shelves, etc., and are generally known in the office furniture industry as "systems furniture". Another arrangement for dividing and/or partitioning open plans includes modular furniture arrangements, in which a plurality of differently shaped, freestanding furniture units are positioned in a side-by-side relationship, with upstanding privacy screens attached to at least some of the furniture units to create individual, distinct workstations and/or offices. Both of these types of modular furniture systems, as well as others, have been widely received due largely to their ability to be readily reconfigured and/or moved to a new site, since they are not part of a permanent leasehold improvement.

In order to gain increased efficiency in the use of expensive office real estate, attempts are now being made to try to support high paid knowledge workers with these types of modular furniture systems in open office settings, instead of conventional private offices. However, in order to insure peak efficiency of such knowledge workers, the workstations must be equipped with the various state-of-the-art utilities and facilities discussed above. Since such workstations must be readily reconfigurable to effectively meet the ever changing needs of the user, the distribution and control of utilities throughout a comprehensive open office plan has emerged as a major challenge to the office furniture industry.

However, known partition systems may be limited in that the adjustability of various hang-on accessories may be quite limited. Furthermore, such systems commonly include a vertical row of openings for supporting such hang-on accessories. The cover panels extending over the partition frames in such systems are necessarily spaced-apart to provide access to the openings for supporting the hang-on accessories. However, the gaps between adjacent cover panels may be quite large, contributing to an unsightly and unaesthetic appearance.

SUMMARY OF THE INVENTION

One aspect of the present invention is to provide a partition frame including vertically spaced apart upper and lower horizontal frame members. The partition frame also includes a pair of horizontally spaced apart vertical frame members extending between and interconnecting the upper and lower frame members to form a generally rectangular frame. The vertical frame members have a vertical row of openings configured to support hang-on system components and accessories such as worktools, worksurfaces, overhead and datum height storage, and utility management features such as a data duct, and the upper frame member also includes a horizontal row of openings configured to support hang-on accessories.

Another aspect of the present invention is a partition frame including a pair of horizontally spaced apart vertical frame members. A partition frame also includes upper and lower vertically spaced apart horizontal frame members extending between and rigidly interconnecting the vertical frame members to form a generally rectangular partition frame. A partition frame includes a base configured to support the partition frame freestanding on a floor surface. The vertical frame members have a tubular rectangular cross section defining a side face, and an elongated edge strip secured to the side face of the tube. The edge strip has a base web in a pair of spaced apart side legs extending therefrom to form a C-shaped cross section.

Yet another aspect of the present invention is a partition frame including a pair of vertical frame members and upper and lower horizontal frame members extending between the vertical frame members and rigidly interconnecting the same to form a rectangular frame defining spaced apart vertical side faces. At least one of the frame members has a first portion with a pair of spaced apart first surfaces that are generally parallel to the vertical side faces. The at least one frame member includes a second portion having side surfaces spaced inwardly from the first surfaces, and the side surfaces include a row of openings therein.

Yet another aspect of the present invention is a partition frame including a pair of spaced apart vertical frame members and at least one horizontal frame member extending between and rigidly interconnecting the vertical frame members. The partition frame further includes a base configured to support the partition frame freestanding on a floor surface in a generally upright position. The partition frame has a height that creates a gap between the top edge of the partition frame and a ceiling. The vertical frame members and the horizontal frame member have substantially the same cross sectional shape.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
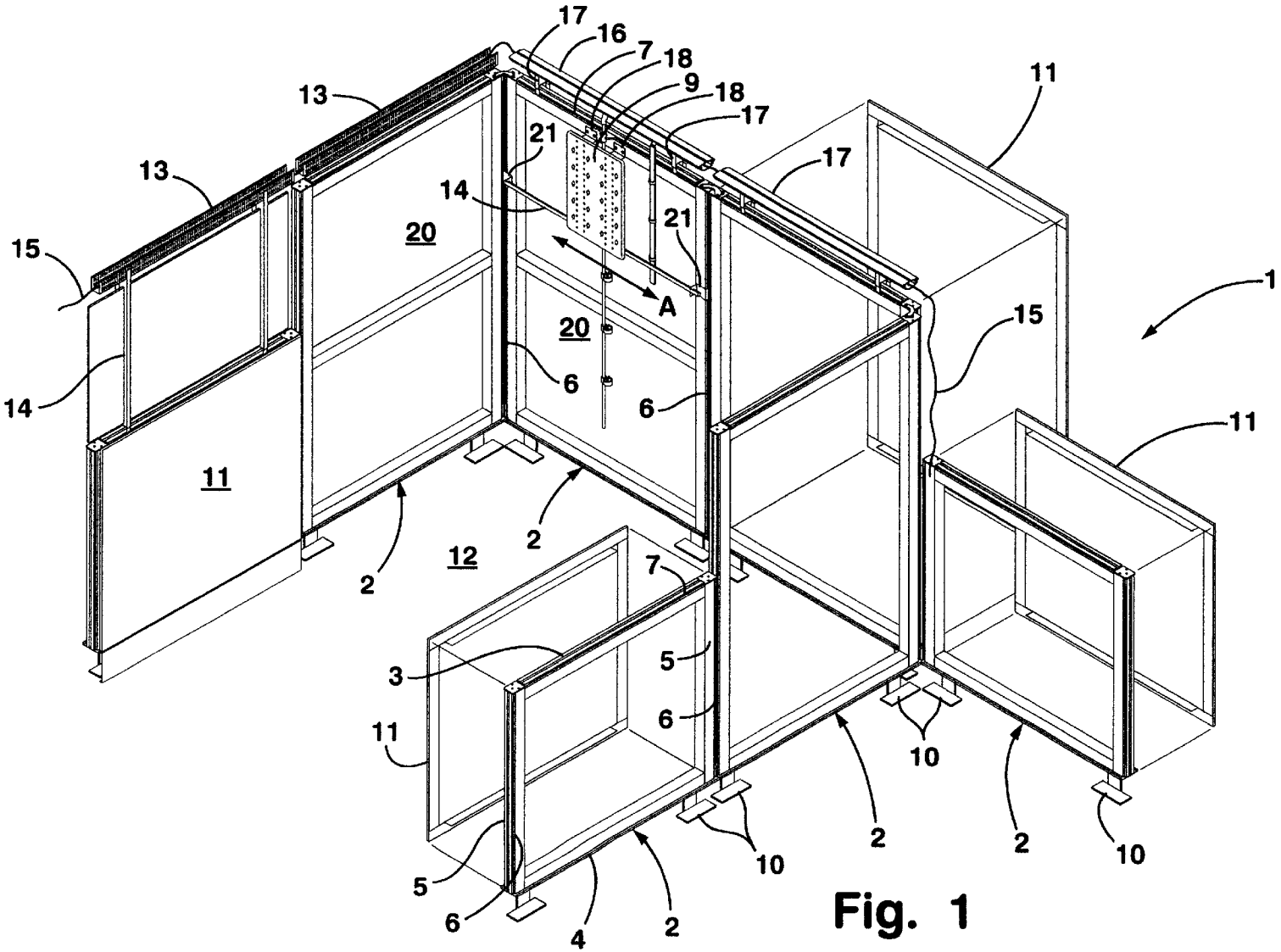
FIG. 1 is a partially fragmentary, perspective view of a panel system incorporating the partition frame according to the present invention, which is particularly suited for use in offices and similar settings and environments.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present application is related to the following co-pending patent applications, the entire contents of each of which are hereby incorporated herein by reference.

| Application No. | Filing Date | Title |
|---|---|---|
| 09/692,663 | October 20, 2000 | PARTITION SYSTEM WITH ELEVATED RACEWAY |
| 09/693,225 | October 20, 2000 | PARTITION PANEL WITH INFILL ARRANGEMENT |
| 09/693,316 | October 20, 2000 | PARTITION SYSTEM WITH WORKTOOLS |
| 09/692,796 | October 20, 2000 | TOP CAP AND SCREEN FOR PARTITIONS |

With reference FIG. 1, a partition system 1 includes a plurality of partition frames 2, each of which includes vertically spaced apart upper and lower frame members 3, 4, respectively. A pair of horizontally spaced apart vertical frame members 5 extend between and interconnect the upper and lower frame members 3 and 4 to form the generally rectangular frame 2. The vertical frame members 5 have a vertical row of openings 6 configured to support hang-on accessories such as worksurfaces 8 (FIG. 2), storage bins, and the like. The upper frame member 3 includes a horizontal row of openings 7 that is also configured to support hang-on accessories, such as a worktool support 9.

Figure 2:
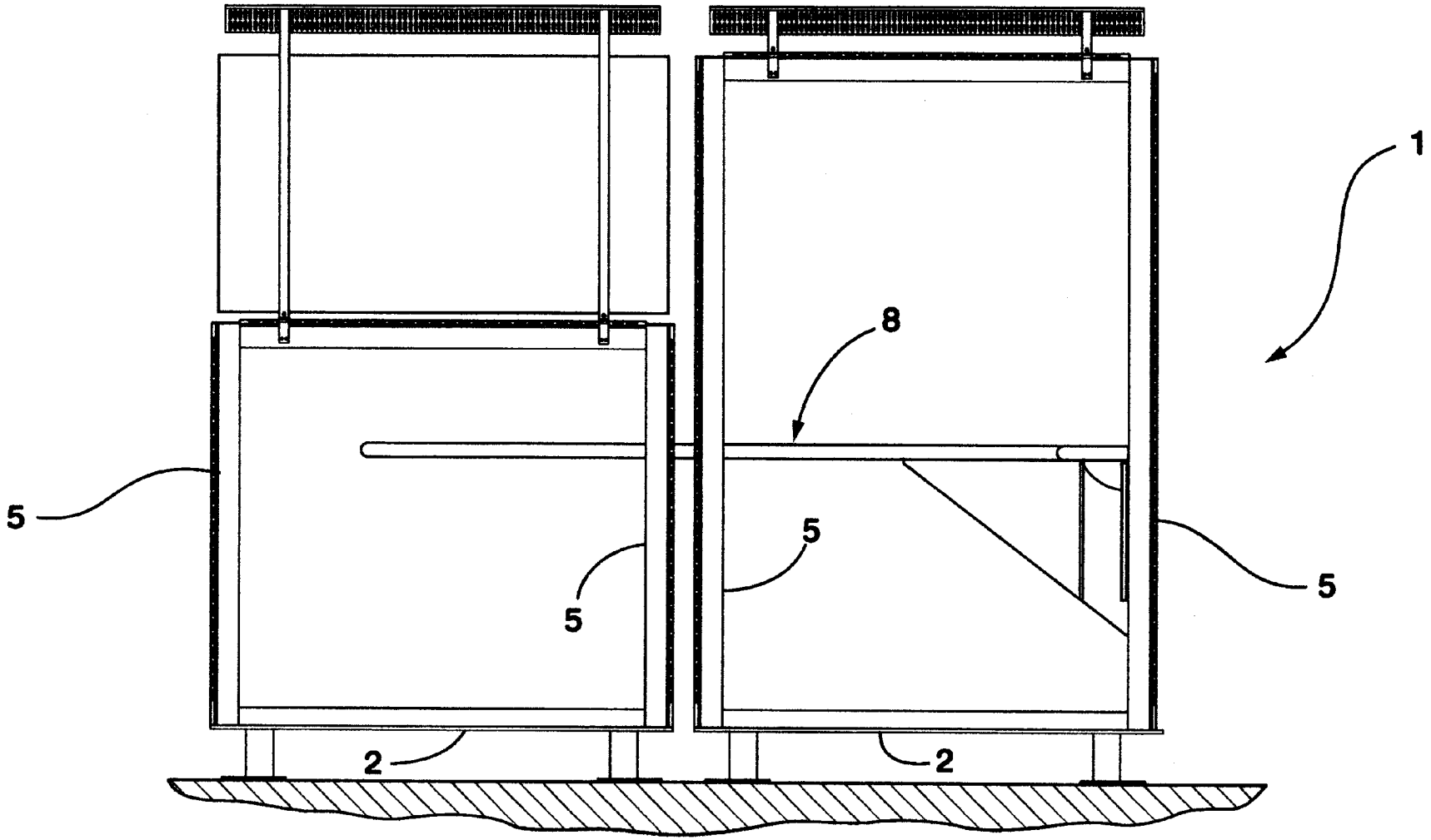
FIG. 2 is a plan view of the partition of FIG. 1.
Figure 6:
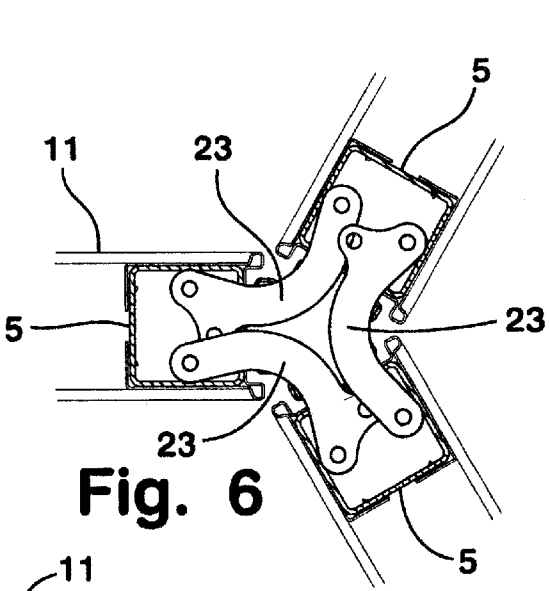
FIG. 6 is a partially fragmentary, plan view of three partition panels located at 120° relative to one another.
Figure 4:
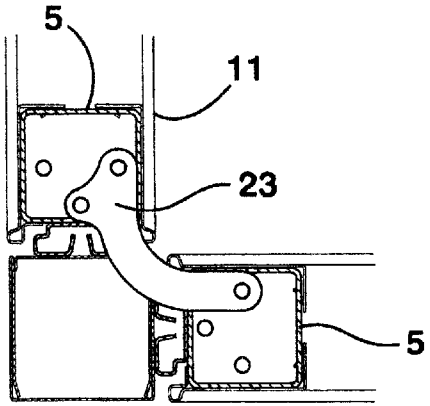
FIG. 4 is a partially fragmentary, plan view of a 90° joint between adjacent partition panels.
Figure 3:
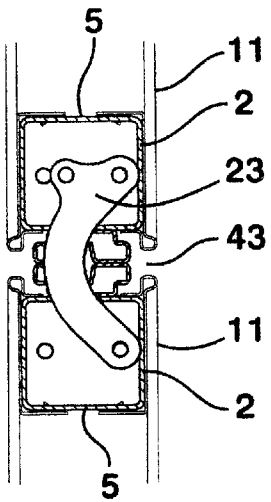
FIG. 3 is a partially fragmentary, plan view of an in-line joint between adjacent partition panels.

The lower frame member 4 and adjustable support feet or glides 10 are substantially the same as the existing Steelcase AVENIR system, such that the lower, or base 4 and glides 10 will not be described in detail herein. If required for a particular application, cover panels 11 may be connected to the partition frame 2 to close off the workspace 12 and provide the desired degree of privacy. Alternately, the partition frames 2 may be utilized in an "open" configuration wherein no cover panels 11 are utilized. The partition frame 2 can thus be adapted for use in a variety of environments, and modified to provide the desired degree of privacy. U-shaped raceways 13 may be connected to the partition frame 2 via supports or brackets 14 to permit lay-in routing of utility lines 15 such as communications ("data") lines or power lines. A second type of raceway 16 having a more closed configuration may also be connected to the partition frames 2 via brackets 17 for routing of utility lines 15. The raceways 13 and 16, and supports or brackets 14 and 17 are described in detail in the above-identified co-pending application entitled PARTITION SYSTEM WITH ELEVATED RACEWAY, and will not therefor be described in detail herein. The worktool support 9 includes a pair of brackets 18 that connect to the horizontal row of slots 7, such that the worktool support 9 can be shifted back and forth in the direction of the arrow "A" (FIG. 1) and connected in a particular location. A horizontal brace 19 extends across the opening 20 of frame 2, and prevents inward rotation of the worktool support 9. A pair of hooked brackets 21 secure the horizontal brace 19 to the partition frame 2 and connect to the vertical rows of slots 6, such that the vertical position of the horizontal base 19 may be varied as required, depending upon the size of the worktool support 9. The worktool support 9, brackets 18, and horizontal brace 19 and brackets 21 are described in detail in the above-identified patent application entitled PARTITION SYSTEM WITH WORKTOOLS, such that these features will not be further described in detail herein. With further reference to FIG. 2, one or more worksurfaces 8 are connected to the vertical rows of openings 6 by large cantilever brackets 22 having hooks (not shown) that engage the openings 6.

Figure 7:
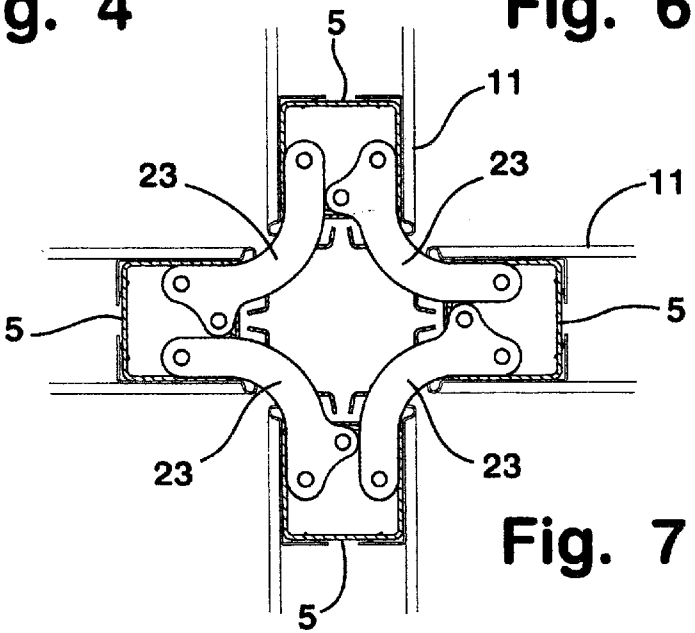
FIG. 7 is a partially fragmentary, plan view of an X-joint between four adjacent partition panels.
Figure 5:
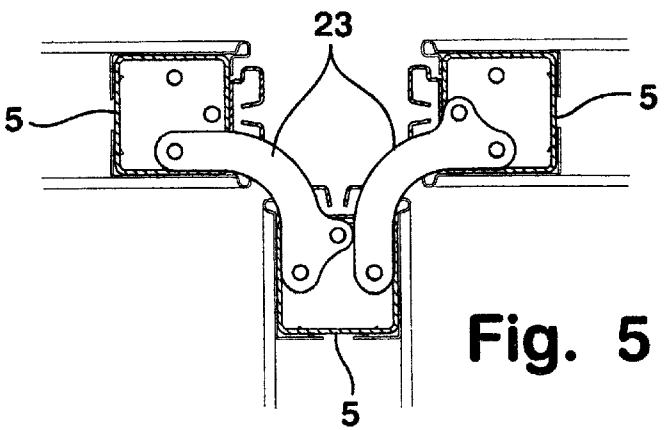
FIG. 5 is a partially fragmentary, plan view of a T-joint between three adjacent partition panels.
Figure 8:
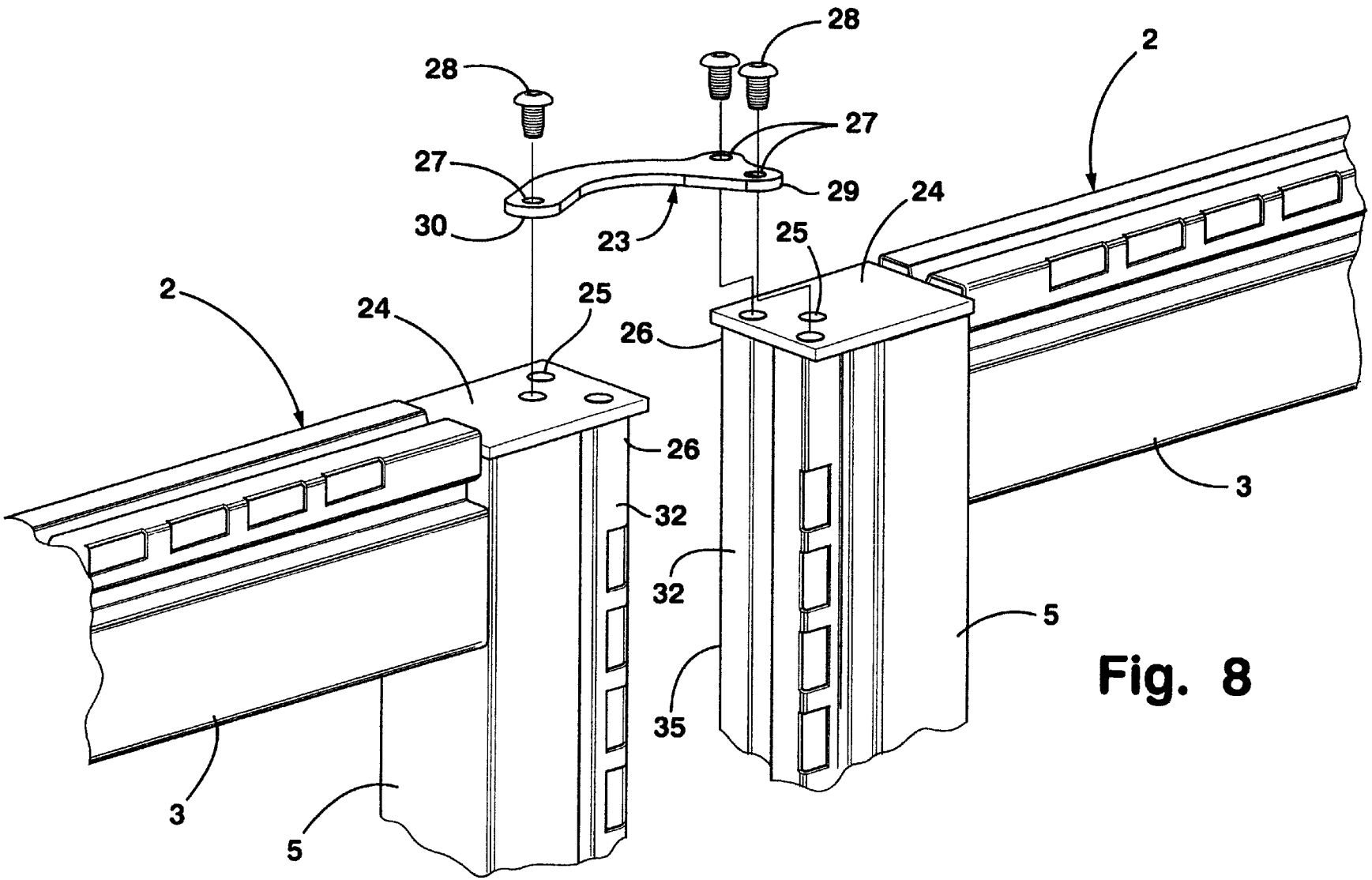
FIG. 8 is a partially fragmentary, perspective view illustrating the panel-to-panel connector.

With reference to FIGS. 3–7, one or more connector plates 23 may be utilized to connect adjacent partition frames 2 together in a variety of configurations. With further reference to FIG. 8, a plate 24 having a plurality of threaded openings 25 is welded to the upper end 26 of each vertical frame member 5. The connector 23 is made of flat plate steel or the like, and includes a plurality of clearance openings 27, such that threaded bolts or fasteners 28 can pass through the clearance openings 27 and thread into the openings 25, thereby interconnecting the adjacent partition frames 2. Because each plate 24 includes three threaded openings 25, and each connector 23 includes two openings 27 at a first end 29 and a single opening 27 at a second end 30, one or more connectors 23 may be utilized to interconnect a pair of partition frames in an in-line configuration (FIG. 3), an L-shaped corner configuration (FIG. 4), a T-shaped configuration (FIG. 5), an equiangular configuration (FIG. 6), or an X-shape (FIG. 7).

Figure 10:
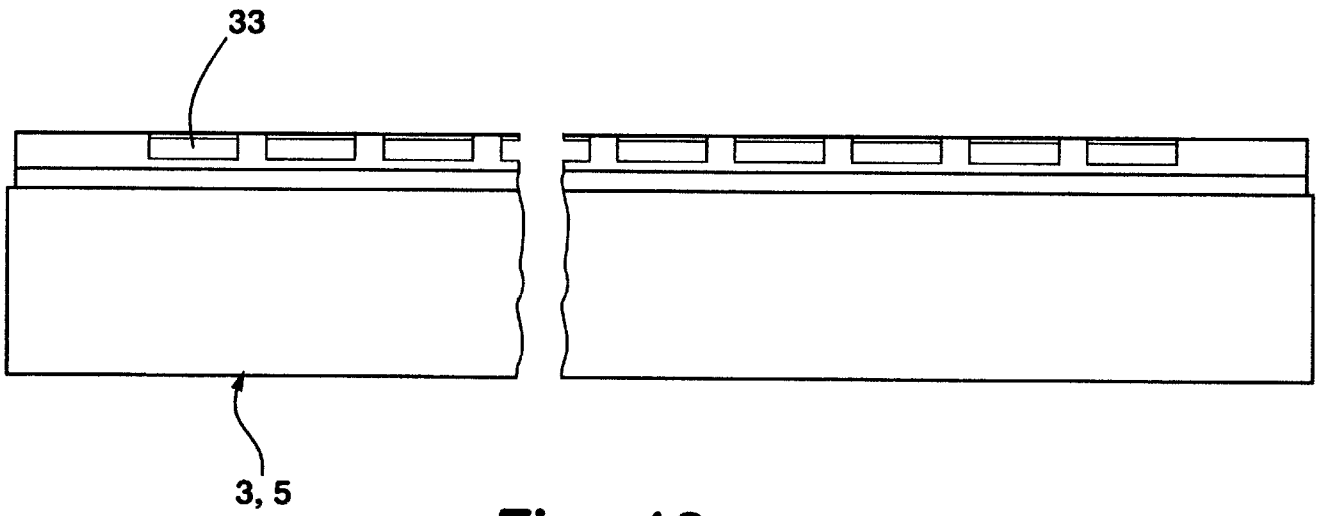
FIG. 10 is a fragmentary, front elevational view of the frame member of FIG. 9.
Figure 9:
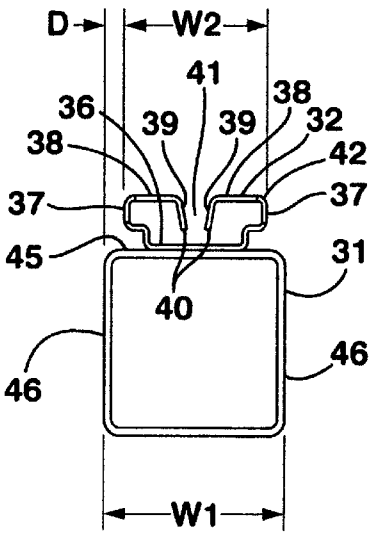
FIG. 9 is a side elevational view of a frame member.

With further reference to FIGS. 9 and 10, the upper frame member 3 and the vertical frame members 5 each have an identical cross sectional configuration including a rectangular tube 31 and an edge strip 32 including a plurality of openings 33 that forms the vertical row of openings 6 and the horizontal row of openings 7. The edge strips 32 form the upper edge 34 (FIG. 8) of a partition frame 2, and also form the vertical side edges 35 of the partition frame 2. Edge strip 32 includes a base web 36 that is welded to the rectangular tube 31. A pair of side webs 37 extend from the base web 36, forming a U-shape. A pair of outer webs 38 extend towards one another from the side webs 37, and a pair of angled flanges 39 extend inwardly towards the base web 36, and terminate at free edges 40 that are spaced apart from the base web 36. The flanges 39 extend inwardly towards one another at an angle, thus forming a truncated V-shaped channel 41. Openings 33 extend through the side webs 37, and the outer web 38 at the corner 42 formed by the webs 37 and 38. Thus, the openings 33 are positioned at the upper edge 34 and side edges 35 of the partition frame 2, thereby reducing the gap 43 (FIG. 3) between adjacent cover panels 11. The frame members 3, 5 include an inner side face 44, an outer side face 45, and a pair of spaced-apart side faces 46. The side faces 46 have a distance "W1" (FIG. 9) therebetween, and the side webs 37 of the edge strip 32 define a distance "W2" therebetween that is less than the distance W1. Accordingly, the side webs 37 of edge strip 32 are offset inwardly from the side faces 46 by a distance "D" thus reducing the visibility of the openings 33. The truncated V-shaped channel 41 may be utilized to mount trim or the like. Furthermore, the angled flanges 39 provide a light block that prevents light from traveling through the openings 33 through the partition and into an adjacent workspace.

The partition frame 2 of the present invention includes both a vertical row of openings 6, and a horizontal row of openings 7, such that various hang-on accessories may be mounted to the partition frame 2 at a selected vertical position, and also at a selected horizontal position. Furthermore, the vertical frame members 5 have substantially the same cross-sectional shape and construction as the upper frame member 3, thereby reducing manufacturing costs. The horizontal row of slots 7 in the upper frame member 3 also permits mounting of various items such as raceways 13 and/or 17 above the partition frame 2. The connector plate 23 and multiple threaded holes 25 permit adjacent partition frames 2 to be interconnected in a wide variety of configurations.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A freestanding partition frame, comprising:

vertically spaced apart upper and lower horizontal frame members;

a pair of horizontally spaced apart vertical frame members extending between and interconnecting said upper and lower frame members to form a generally rectangular frame;

said vertical frame members having a vertical row of openings configured to support as hang-on accessories;

said upper frame member including a horizontal row of openings configured to support hang-on accessories; and at least one hang-on accessory having a connector engaging at least a selected one of said openings.

2. The partition frame set forth in claim 1, wherein:

said vertical frame members and said upper frame member having substantially the same cross-sectional shape.

3. The partition frame set forth in claim 2, wherein:

said partition frame defines spaced apart parallel vertical side faces, said vertical and horizontal rows of openings spaced inwardly from said side faces.

4. A partition frame, comprising:

vertically spaced apart upper and lower horizontal frame members;

a pair of horizontally spaced apart vertical frame members extending between and interconnecting said upper and lower frame members to form a generally rectangular frame;

said vertical frame members having a vertical row of openings configured to support hang-on accessories;

said upper frame member including a horizontal row of openings configured to support hang-on accessories;

said vertical frame members and said upper frame member having substantially the same cross-sectional shape;

said partition frame defines spaced apart parallel vertical side faces, said vertical and horizontal rows of openings spaced inwardly from said side faces; and wherein:

said vertical frame members and said upper frame member each include a tube having a rectangular cross-sectional shape including parallel side faces and an inner face and an outer face, said vertical frame members including a channel extending along said outer-face.

5. The partition frame set forth in claim 4, wherein:

said vertical frame members include a pair of tapered walls forming said channel such that said channel has a truncated V-shape in cross section.

6. The partition frame set forth in claim 5, wherein:

said vertical frame members include an elongated strip secured to said tube, said elongated strip having a base web and a pair of spaced apart webs extending therefrom, each of which includes a flange extending therefrom at an angle towards said base web, each flange terminating at a free edge that is spaced apart from said base web to form said truncated V-shape.

7. A partition frame, comprising:

a pair of horizontally spaced apart vertical frame members;

upper and lower vertically spaced apart horizontal frame members extending between and rigidly interconnecting said vertical frame members to form a generally rectangular partition frame, said partition frame including a base configured to support said partition frame freestanding on a floor surface;

said vertical frame members having a tube with a rectangular cross section defining a side face; and an elongated edge strip secured to said side face of said tube, said edge strip having a base web and a pair of spaced apart side webs extending therefrom to form a C-shaped cross section;

each side web has a row of openings therethrough; and wherein:

said upper horizontal frame member has substantially the same cross sectional shape as said vertical frame members.

8. The partition frame set forth in claim 9, wherein:

each side web includes a flange extending towards said base web and terminating at a free edge spaced apart from said base web.

9. The partition frame set forth in claim 9, wherein:

said edge strips are welded to said tubes.

10. A partition panel, comprising:

a partition frame including a pair of vertical frame members and upper and lower horizontal frame members extending between said vertical frame members and rigidly interconnecting the same to form a rectangular frame defining spaced apart vertical side faces; at least one of said frame members having a first portion with a pair of spaced apart first surfaces that are generally parallel to said vertical side faces, said at least one frame member including a second portion having side surfaces spaced inwardly from said first surfaces, said side surfaces including a row of openings therein;

at least one cover panel secured to said partition frame and having an edge portion extending over at least a portion of said first surfaces, said at least one cover panel configured such that said row of openings is unobstructed to permit hang-on items to be supported by said row of openings.

11. A partition frame, comprising:

a pair of vertical frame members and upper and lower horizontal frame members extending between said vertical frame members and rigidly interconnecting the same to form a rectangular frame defining spaced apart vertical side faces;

at least one of said frame members having a first portion with a pair of spaced apart first surfaces that are generally parallel to said vertical side faces, said at least one frame member including a second portion having side surfaces spaced inwardly from said first surfaces, said side surfaces including a row of openings therein; and wherein:

said upper frame member has substantially the same cross sectional shape as said vertical frame members.

12. The partition frame set forth in claim 11, wherein:

said second partition portion includes a base web and a pair of spaced apart side webs forming said side surfaces.

13. The partition frame set forth in claim 13, wherein:

said first portion has a tubular quadrilateral cross sectional shape.

14. The partition frame set forth in claim 14, wherein:

each side web includes a flange extending towards said base web to form a channel.

15. The partition frame set forth in claim 14, wherein:

each flange terminates at a free edge spaced apart from said base web to form a truncated V-shape.

16. The partition frame set forth in claim 15, wherein:

each second portion includes a pair of outer webs extending from said side webs to form a corner, said rows of openings extending along said corner through said side webs and through said outer webs.

17. A partition frame, comprising:

a pair of spaced apart vertical frame members and at least one horizontal frame member extending between and rigidly interconnecting said vertical frame members, said partition frame further including a base configured to support said partition frame freestanding on a floor surface in a generally upright position, said partition frame having a height that creates a gap between a top edge of said partition frame and a ceiling, said vertical frame members and said horizontal frame member having substantially the same cross sectional shape; and wherein:

said vertical frame members and said horizontal frame member include a row of openings to support hang-on accessories.

* * * * *

UNITED STATES PATENT AND TRADEMARK OFFICE

CERTIFICATE OF CORRECTION

PATENT NO. : 6,481,163 B1
DATED : November 19, 2002
INVENTOR(S) : Jonathan J. King et al.

It is certified that error appears in the above-identified patent and that said Letters Patent is hereby corrected as shown below:

Column 7,
Line 1, "claim 9" should be -- claim 7 --.
Line 5, "claim 9" should be -- claim 8 --.

Column 8,
Line 7, "claim 13" should be -- claim 12 --.
Line 10, "claim 14" should be -- claim 13 --.

Signed and Sealed this

First Day of April, 2003

JAMES E. ROGAN
*Director of the United States Patent and Trademark Office*